US007273264B2

(12) United States Patent
Nagashima

(10) Patent No.: US 7,273,264 B2
(45) Date of Patent: Sep. 25, 2007

(54) IMAGE FORMING APPARATUS AND METHOD

(75) Inventor: Kanji Nagashima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 349 days.

(21) Appl. No.: 10/950,592

(22) Filed: Sep. 28, 2004

(65) Prior Publication Data

US 2005/0088484 A1 Apr. 28, 2005

(30) Foreign Application Priority Data

Sep. 29, 2003 (JP) ..... 2003-338830

(51) Int. Cl.
*B41J 2/21* (2006.01)

(52) U.S. Cl. ..... 347/43

(58) Field of Classification Search ..... 347/15, 347/43, 95, 96, 98, 100, 40
See application file for complete search history.

(56) References Cited

U.S. PATENT DOCUMENTS

| | | | | |
|---|---|---|---|---|
| 5,581,284 | A * | 12/1996 | Hermanson | 347/43 |
| 6,030,065 | A * | 2/2000 | Fukuhata | 347/15 |
| 6,871,945 | B2 * | 3/2005 | Smith et al. | 347/96 |
| 2002/0163557 | A1 * | 11/2002 | Du et al. | 347/43 |
| 2003/0007024 | A1 | 1/2003 | Fujimori | |
| 2003/0090686 | A1 | 5/2003 | Fujimori | |

FOREIGN PATENT DOCUMENTS

| | | | |
|---|---|---|---|
| JP | 2000-94717 | A | 4/2000 |
| JP | 2000-141714 | A | 5/2000 |
| JP | 2003-127438 | A | 5/2003 |

* cited by examiner

*Primary Examiner*—Lamson Nguyen
(74) *Attorney, Agent, or Firm*—Birch, Stewart, Kolasch & Birch, LLP

(57) ABSTRACT

The image forming apparatus forms an image on a recording medium by using coloring materials of a plurality of colors including at least cyan, magenta and yellow, and the apparatus comprises: a cyan recording head which has a plurality of cyan recording elements for forming cyan recording pixels on the recording medium; a magenta recording head which has a plurality of magenta recording elements for forming magenta recording pixels on the recording medium; a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head.

6 Claims, 9 Drawing Sheets

FIG.7A
C, M, Bk DOT ARRANGEMENT
FIG.7B
Y DOT ARRANGEMENT
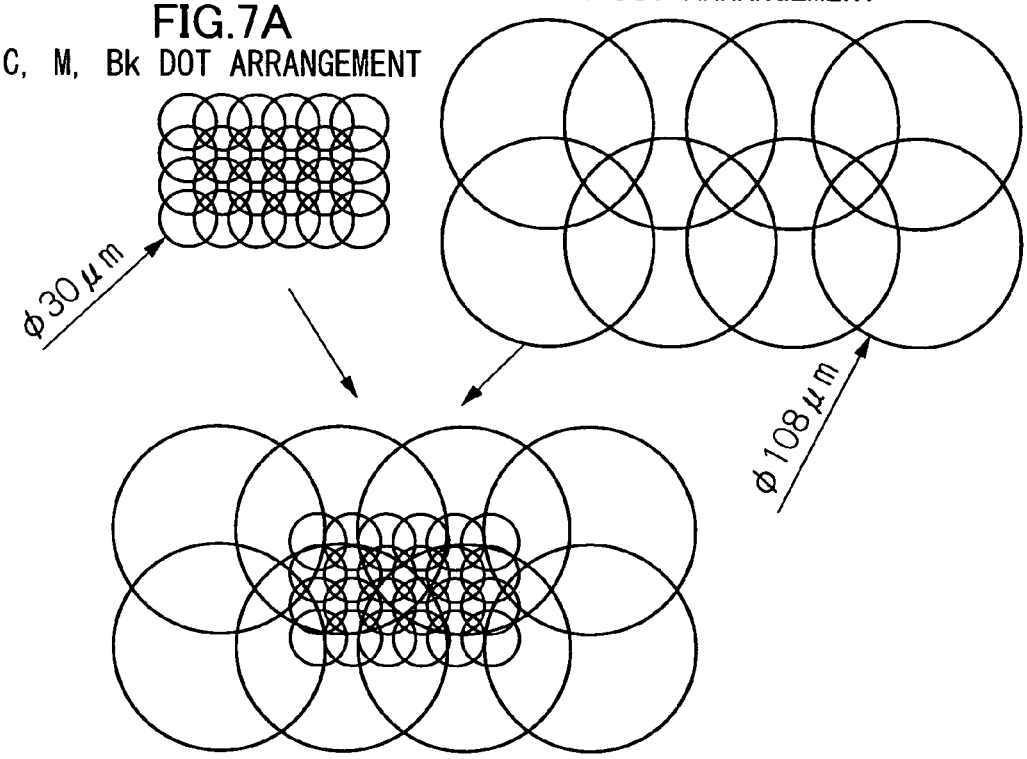
FIG.7C
FIG.8
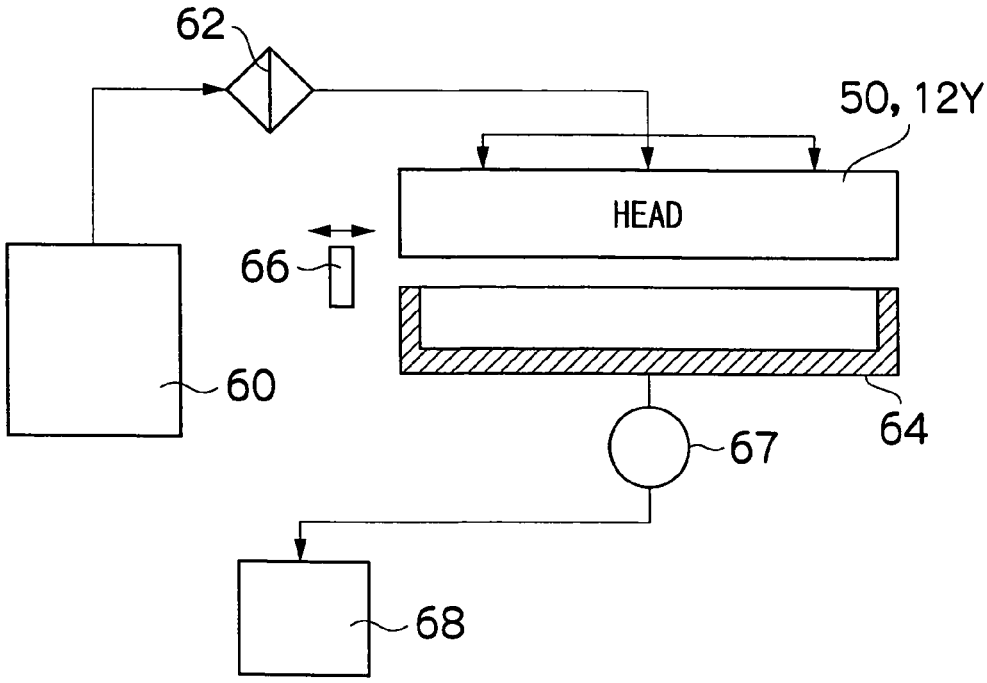

IMAGE FORMING APPARATUS AND METHOD

This Non-provisional application claims priority under 35 U.S.C. § 119(a) on Patent Application Ser. No(s). 2003-338830 filed in Japan on Sep. 29, 2003, the entire contents of which are hereby incorporated by reference.

BACKGROUND OF THE INVENTION

1. Field of the Invention

The present invention relates to an image forming apparatus and method, and more particularly, to the structure of a recording head suitable for an inkjet recording apparatus forming color images by using inks of a plurality of colors, and to recording control technology for same.

2. Description of the Related Art

When printing a color image, an inkjet printer uses inks of at least three colors, cyan (C), magenta (M), and yellow (Y), and furthermore, it may also form images using black (Bk), light cyan (LC), light magenta (LM), dark yellow (DY) and a special color (SPC), and the like.

In general, there are many examples of printers corresponding to print output of high quality (photographic standard quality) which use six or more colors of ink. In inkjet printers of this kind, generally, the nozzle density in the head is set to the same density for each of the colors. Examples are known wherein document printing speed is emphasized, and Bk nozzles only are provided in greater number and higher density than the other colors, but in this case, all of the colors other than Bk are set to the same nozzle density as each other. In other words, generally, as the number of colors becomes greater, so the number of nozzles increases, accordingly.

Furthermore, in a conventional inkjet printer, in order to shorten the printing time, the time interval between ink discharges has been shortened (the discharge frequency has been increased), and the number of ink discharge nozzles in the recording head has been increased. Increase in the discharge frequency has been achieved either by raising the upper limit of the response frequency of the discharge mechanism (the pressurizing devices, such as a piezo element, or the heater), or by replenishing ink more quickly after ink discharge. Furthermore, increasing the number of discharge nozzles is achieved by improving the head processing and fabrication technology, and increasing miniaturization and density, and even in an inexpensive inkjet printer, the overall number of nozzles can be several thousand.

Due to improvements of these kinds, it has been possible to shorten the printing time, but on the other hand, the following types of problems have arisen. More specifically, the increase in the number of nozzles described above leads to problems in that, in addition to raising the cost of the device, the increase in the total number of nozzles, and the fact that the total length of the flow passages inside the head for supplying ink to these respective nozzles becomes longer, give rise to an increased possibility of an ink discharge problem occurring in the head.

This is not limited to an increased probability of simple breakdowns, but rather means that there is an increased possibility of problems which are intrinsic to inkjet systems, such as air bubbles becoming trapped inside the ink flow passages and it becoming impossible to perform normal discharge, or the ink viscosity rising in the vicinity of the nozzles and causing discharge failures.

More particularly, in a single-pass type inkjet printer, which, unlike a shuttle scan type printer for printing by scanning an inkjet head back and forth, has a fixed head of a length not shorter than the print image and performs printing by conveying printing paper in a direction orthogonal to the longitudinal direction of the head, the number of nozzles per ink color may exceed 10,000, and hence the issue of increased possibility of problems such as those described above is very serious indeed.

In order to deal with the issue of problems of this kind, although it runs counter to improvements aimed at enhancing image quality, if the number of nozzles could be reduced, then the possibility of problems occurring can also be reduced.

In relation to reducing the number of nozzles, Japanese Patent Application Publication No. 2000-94717 discloses technology wherein, in an inkjet printer using a head having ink discharge nozzles arranged in a staggered matrix, a structure is adopted whereby black, cyan, magenta and yellow (Bk, C, M and Y) inks, a diluting ink, and a cleaning solution can be supplied to any desired subsidiary tank of the head, and nozzle rows are allocated in a two-row arrangement for magenta and cyan, and nozzle rows are allocated in a one-row arrangement for yellow and black, whereby the number of nozzles for the two colors, yellow and black, is half the number of nozzles for cyan and magenta.

In Japanese Patent Application Publication No. 2000-94717, an embodiment is disclosed wherein yellow and black are set to 300 dpi and cyan and magenta are set to 600 dpi; however, there is no disclosure regarding the method for ejecting droplets of yellow ink in order to achieve a suitable density which balances with the other inks, or regarding the dot size and ink density of the yellow ink, in the case where the number of nozzles for yellow ink is fewer than those for other inks.

Moreover, Japanese Patent Application Publication No. 2003-127438, discloses technology for reducing the resolution of the yellow color only and technology for reducing the resolution of colors having a smaller number of nozzles, if different numbers of nozzles are provided for each color.

In the technology proposed in Japanese Patent Application Publication No. 2003-127438, even in a head composition in which the number of nozzles of other colors of ink is one half that of the number for black, when forming color images, the aim is, however, to increase speed by reducing the image resolution and reducing the number of scan operations by one half, and the technology indicates how to print the data corresponding to two pixels of the color ink, in one pixel, and how to assign print data for light type inks and for normal inks in divergent nozzle positions based on a staggered matrix arrangement, but it does not resolve the problem of reducing the possibility of the occurrence of problems due to the increase in the number of nozzles as described above.

SUMMARY OF THE INVENTION

The present invention is contrived in view of such circumstances, and an object thereof is to provide an image forming apparatus and method whereby the possibility of occurrence of problems associated with increase in the number of nozzles (number of recording elements) can be reduced, while achieving high quality image recording.

In order to attain the aforementioned object, the present invention is directed to an image forming apparatus which forms an image on a recording medium by using coloring materials of a plurality of colors including at least cyan, magenta and yellow, the apparatus comprising: a cyan recording head which has a plurality of cyan recording elements for forming cyan recording pixels on the recording medium; a magenta recording head which has a plurality of magenta recording elements for forming magenta recording pixels on the recording medium; a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head.

According to the present invention, since the recording element density of the yellow recording head is set to a lower density than the cyan recording head and the magenta recording head, on the basis of the differences in the detective capacity of the human eye with respect to cyan, magenta and yellow, and since yellow recording pixels are formed onto the recording medium at a recording density that is lower than the other colors, then it is possible to reduce the number of yellow recording elements in comparison to the cyan and magenta recording elements. Thereby, it is possible to achieve compactification of the yellow recording head, and consequently, compactification of the overall device, reduced costs, reduction in the coloring materials and energy required to form recording pixels, and reduction in the rate of occurrence of recording problems.

Here, "coloring material" indicates a material for imparting a color, and it includes dyes, pigments, or paint including same, ink, color photographic pigments, chromogenic material in a chromogenic layer, or the like.

Preferably, the recording density of the yellow recording pixels is lower than each of the recording density of the cyan recording pixels and the recording density of the magenta recording pixels, at least in a direction in which the yellow recording elements are aligned in greater number in the yellow recording head.

If an image is formed by relative movement of the recording head and the recording medium, then the recording density is reduced at least in the direction in which the recording elements are aligned in greater number in the recording element rows (the main scanning direction in the case of a line head), and more preferably, the recording density is reduced in the relative movement direction as well.

Preferably, the recording density of the yellow recording pixels is 1/n of each of the recording density of the cyan recording pixels and the recording density of the magenta recording pixels, where n is a number at least 2, preferably more than 2, and more preferably, the recording density of the yellow recording pixels is at most one third of each of the recording density of the cyan recording pixels and the recording density of the magenta recording pixels. Due to the visual perceptibility of yellow, it is possible to ensure image quality without causing deterioration of the image even reducing the density to this degree.

Preferably, a size of the yellow recording pixels is greater than each of a size of the cyan recording pixels and a size of the magenta recording pixels. Since granularity is not liable to be perceived in yellow dots, in comparison with cyan and magenta, then even if the dots are large in size, image quality can be guaranteed without causing deterioration in the image.

If the recording density for yellow is taken to be 1/n ($n \geqq 2$) of the recording density of cyan and magenta, then recording conditions are preferably determined whereby the recording pixel sizes on the recording medium have a relationship wherein the size of the yellow recording pixels increases with increase in "n", for instance, the size of the yellow recording pixels is set to be n times or $\sqrt{n}$ times the size of the cyan or magenta recording pixels.

Preferably, a concentration of the yellow recording pixels is higher than each of a concentration of the cyan recording pixels and a concentration of the magenta recording pixels. It is preferable that the color concentration of the yellow recording pixels is increased, in order to compensate for the decline in color concentration caused by decrease in the recording density. By this means, the color concentration in the image can be guaranteed.

Preferably, the yellow recording head is a full line recording head in which the plurality of yellow recording elements are arranged through a length not shorter than a recording width of the recording medium. If the present invention is applied to a high-density recording head, and more particularly, a long, full line recording head wherein a plurality of recording elements are arranged, it is possible substantially to reduce the total number of recording elements, and hence an extremely large beneficial effect is obtained.

A "full line recording head" is usually disposed following a direction that is orthogonal to the relative direction of conveyance of the recording medium (direction of relative movement), but modes may also be adopted wherein the recording head is disposed following an oblique direction that forms a prescribed angle with respect to the direction orthogonal to the direction of relative movement. Moreover, the arrangement of the recording elements in the recording head is not limited to being a single line type arrangement, and a matrix arrangement comprising a plurality of rows may also be adopted. Furthermore, a mode may also be adopted wherein a row of recording elements corresponding to the full width of the recording paper is constituted by combining a plurality of short dimension recording head units having recording element rows which do not reach a length corresponding to the full width of the recording medium.

"Recording medium" indicates a medium on which an image is recorded by means of the action of the recording head (this medium may also be called a print medium, image forming medium, image receiving medium, or the like), and this term includes various types of media, of all materials and sizes, such as continuous paper, cut paper, sealed paper, resin sheets, or such as OHP sheets, film, cloth, a printed circuit board whereon a wiring pattern, is formed by means of an inkjet recording apparatus, and other materials. In the present specification, the term "printing" indicates the concept of forming images in a broad sense, including text.

The movement device (conveyance device) for causing the recording medium and the recording head to move relative to each other may include a mode where the recording medium is conveyed with respect to a stationary (fixed) recording head, or a mode where a recording head is moved with respect to a stationary recording medium, or a mode where both the recording head and the recording medium are moved.

Preferably, the yellow recording head includes a liquid discharging head which has nozzles for discharging at least one of a liquid for fixing an ink used as the coloring materials onto the recording medium, a coating liquid for protecting pigment in the coloring materials, and a liquid for forming a protective film for protecting the coloring materials from rubbing or abrasion. It is possible to use the space created by reducing the number of recording elements in the yellow recording head, to dispose the nozzles for discharging a liquid having another function.

Preferably, the yellow recording pixels are recorded onto the recording medium by means of control involving at least one of a size modification and a concentration modification of the yellow recording pixels. As a method for representing tonal graduation in an image, it is possible to use modification of the recording pixel size whereby the size of the recording pixels is changed, or modification of the color concentration whereby the color concentration is changed, or to use a combination of these techniques.

Alternatively, it is also preferable that the yellow recording pixels are recorded onto the recording medium by means of control involving a surface area modification of the yellow recording pixels. As a method for representing tonal graduation in an image, it is also possible to use surface area modification, typical examples of which include error diffusion, dithering, or the like.

Preferably, the recording density of the yellow recording pixels is not less than 300 dpi and not more than 600 dpi, and each of the recording density of the cyan recording pixels and the recording density of the magenta recording pixels is not less than 1,200 dpi. Thereby, it is possible to form images of high quality, while at the same time being able to achieve compactification, reduced costs and improved reliability, and the like, by cutting the number of yellow recording elements.

Preferably, the density of the plurality of yellow recording elements arranged in the yellow recording head is at most one half of each of the density of the plurality of cyan recording elements arranged in the cyan recording head and the density of the plurality of magenta recording elements arranged in the magenta recording head, and more preferably, the density of the plurality of yellow recording elements arranged in the yellow recording head is at most one third of each of the density of the plurality of cyan recording elements arranged in the cyan recording head and the density of the plurality of magenta recording elements arranged in the magenta recording head. If a row of recording elements of high density achieving a resolution of 1,200 dpi or above is provided in the respective cyan and magenta recording heads, then it is possible to obtain sufficient image quality, even if the recording element density in the yellow recording head is one half or less, more preferably one third or less thereof.

Preferably, each of the cyan recording elements, the magenta recording elements and the yellow recording elements comprises: a nozzle which discharges ink of a corresponding color; an ink chamber which is connected to the nozzle and is filled with the ink to be discharged from the nozzle; and a pressure generating device which supplies discharge force by pressurizing the ink inside the ink chamber, wherein the recording pixels of the corresponding color are formed on the recording medium by means of the corresponding color ink droplets discharged from the nozzle. More specifically, the present invention is suitable for application to an inkjet recording apparatus, and has particularly beneficial effects for inkjet systems, such as reducing the occurrence of discharge errors, improving maintenance characteristics.

Preferably, a diameter of the nozzles of the yellow recording elements is greater than each of a diameter of the nozzles of the cyan recording elements and a diameter of the nozzles of the magenta recording elements. By increasing the size of the nozzles, abnormalities in ink discharge become less liable to occur, and the maintenance frequency for the nozzles is reduced.

Preferably, the yellow recording elements are driven to discharge the yellow ink droplets at a higher frequency than an ink discharge frequency determined according to a relative speed of the recording medium and the yellow recording head, and the recording density of the yellow recording pixels; and one yellow recording pixel is formed by a plurality of yellow ink droplets.

In order to achieve a prescribed recording density, it is necessary to discharge ink droplets at a prescribed ink discharge frequency calculated on the basis of the relative speed between the recording medium and the head. In some cases, however, the size of the yellow recording pixels is increased, or one recording pixel is formed by means of a plurality of discharged ink droplets in order to raise the color concentration; and hence, ink discharge is performed at a higher frequency that the prescribed ink discharge frequency calculated as described above, and in practice, a plurality of ink droplets are discharged onto the same position (substantially, one dot position). Alternatively, a plurality of ink droplets are discharged onto mutually connecting positions on the recording medium, and this plurality of ink droplets consolidates together due to the effects of surface tension, and forms a single recording pixel.

The present invention also provides a method for attaining the aforementioned objects. More specifically, the present invention is also directed to a method of forming an image on a recording medium by using coloring materials of a plurality of colors including at least cyan, magenta and yellow, the method comprising the steps of: forming cyan recording pixels on the recording medium with a cyan recording head having a plurality of cyan recording elements; forming magenta recording pixels on the recording medium with a magenta recording head having a plurality of magenta recording elements; forming yellow recording pixels on the recording medium with a yellow recording head having a plurality of yellow recording elements, a density of the plurality of yellow recording elements arranged in the yellow recording head being lower than each of a density of the plurality of cyan recording elements arranged in the cyan recording head and a density of the plurality of magenta recording elements arranged in the magenta recording head; and controlling the cyan recording pixels forming step, the magenta recording pixels forming step and the yellow recording pixels forming step in such a manner that a recording density of the yellow recording pixels formed on the recording medium in the yellow recording pixels forming step is lower than each of a recording density of the cyan recording pixels formed on the recording medium in the cyan recording pixels forming step and a recording density of the magenta recording pixels formed on the recording medium in the magenta recording pixels forming step.

According to the present invention, in an image forming apparatus for forming images on a recording medium by using coloring materials of a plurality of colors, including at least cyan, magenta and yellow, since the recording element density of the yellow recording head is set to a lower density than the cyan recording head and the magenta recording head, and since yellow recording pixels are formed at a recording density that is lower than the other colors, then the number of yellow recording elements can be reduced, and therefore, it is possible to achieve compactification of the head, reduced costs, reduction in the coloring materials and energy required to form recording pixels, improved reliability, and the like.

Furthermore, in the present invention, high quality image forming is possible by ensuring the yellow recording density and color concentration required in order to avoid image deterioration in relation to the visual perceptibility of yellow.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 7A, 7B and 7C are descriptive diagrams showing an example of a dot arrangement achieved by means of the present embodiment;

FIG. 8 is a schematic drawing showing a configuration of an ink supply system in the inkjet recording apparatus;

DETAILED DESCRIPTION OF THE PREFERRED EMBODIMENTS

General Configuration of an Inkjet Recording Apparatus

Figure 1:
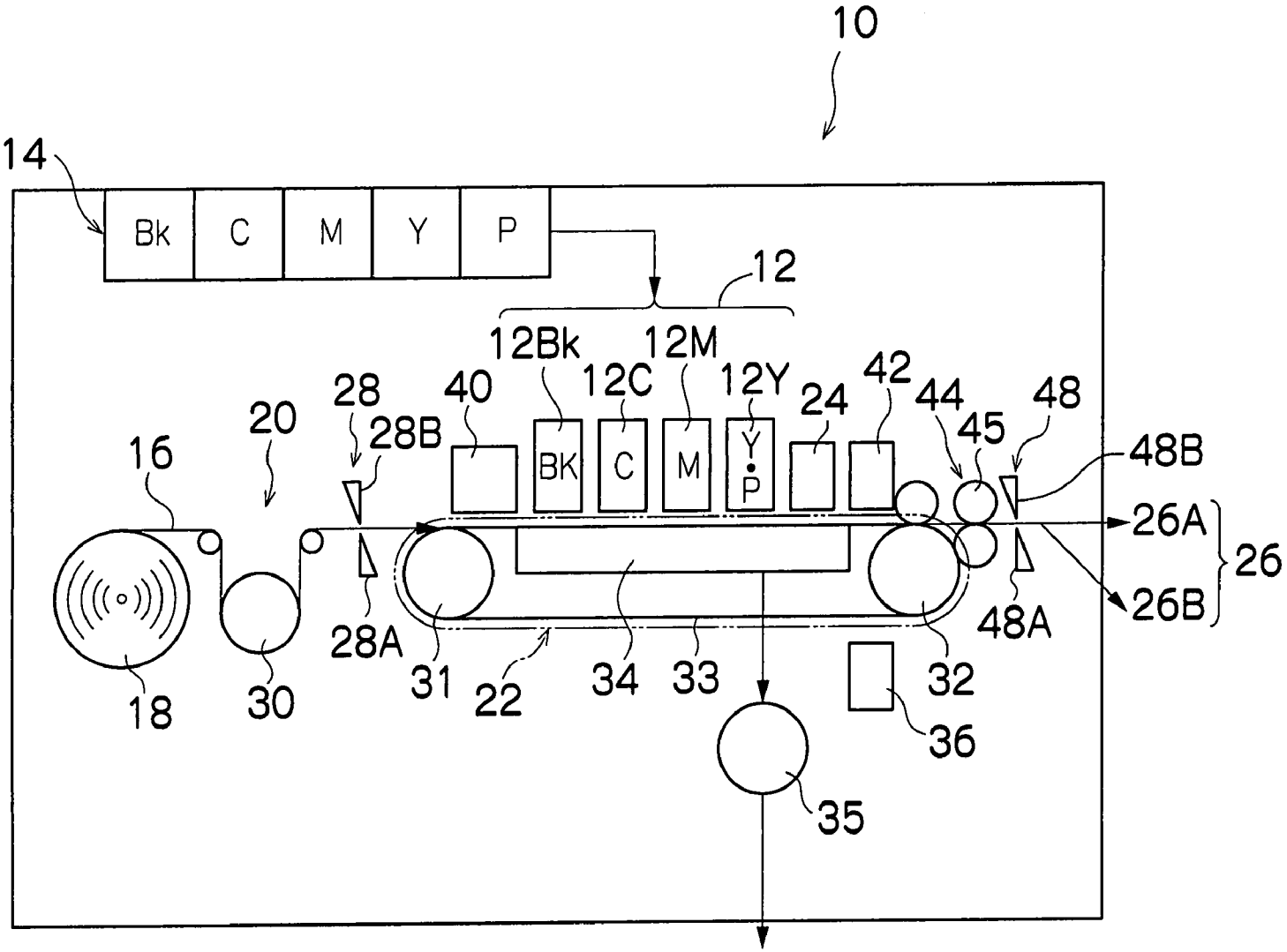
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of recording heads or print heads 12Bk, 12C, 12M, and 12Y for ink colors of black (Bk), cyan (C), magenta (M), and yellow (Y), respectively; an ink and protective liquid storing and loading unit 14 for storing inks of Bk, C, M and Y and protective liquid (P) to be supplied to the print heads 12Bk, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 9) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
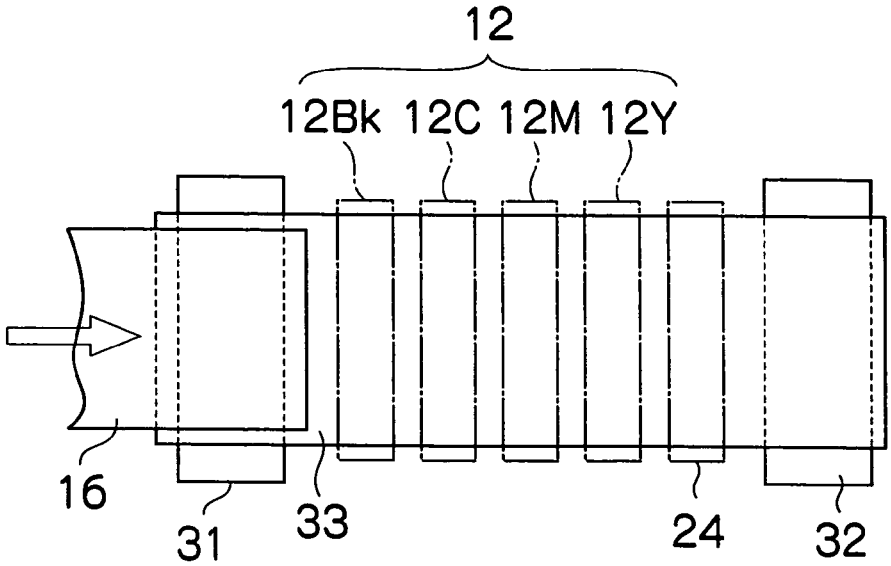
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12Bk, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12Bk, 12C, 12M, and 12Y are arranged in this order from the upstream side along the paper conveyance direction. A color print can be formed on the recording paper 16 by ejecting the inks from the print heads 12Bk, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the BkCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

In the present embodiment, the nozzles in the print head 12Y (hereinafter referred to as the Y head 12Y) for yellow ink have lower density than other heads for other colors. For example, in the present embodiment, the nozzles for black, cyan and magenta have the density equivalent to 2,400 npi (nozzles per inch), and the nozzles for yellow have the density equivalent to 600 npi. The Y head 12Y further includes nozzles for discharging protective liquid by utilizing a space that has been cleared by reducing the nozzles for discharging the yellow ink. The nozzles for discharging protective liquid have the density equivalent to 150 npi, for example.

As shown in FIG. 1, the ink and protective liquid storing and loading unit 14 has tanks for storing the inks of Bk, C, M and Y and the protective liquid P to be supplied to the print heads 12Bk, 12C, 12M, and 12Y, and the tanks are connected to the print heads 12Bk, 12C, 12M, and 12Y through channels (not shown), respectively. The ink and protective liquid storing and loading unit 14 has a warning device (e.g., a display device, an alarm sound generator) for warning when the remaining amount of any ink or protective liquid is low, and has a mechanism for preventing loading errors among the colors.

In the present embodiment, the printed dots formed by the Y ink droplets ejected from the Y head 12Y have a larger diameter than that of other colors, and the Y ink then permeates into the recording paper 16 more deeply than other color inks. The Y ink thereby has a relatively low color development (reflection efficiency), considering the amount of discharged ink. Hence, the discharging amount of the Y ink should be larger than those of other color inks in order to obtain an appropriate color development, and it is then preferable that the tank for the Y ink be larger than those of other inks.

The protective liquid makes a protective film for protecting the ink coloring matter and the surface of the recording paper from gases such as oxygen and ozone, light such as visible light and ultraviolet, and external force such as rubbing and abrasion. The protective liquid naturally dries after applied on the recording paper 16, and is also dried and fixed by the following post-drying unit 42 and heating/pressurizing unit 44.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor. The print determination unit 24 is configured with at least a line sensor or area sensor having rows of photoelectric transducing elements with a width that is greater than the ink-droplet ejection width (image recording width) of the print heads 12Bk, 12C, 12M, and 12Y.

The print determination unit 24 reads a test pattern printed with the print heads 12Bk, 12C, 12M, and 12Y for the respective colors, and the ejection of each head is determined. The ejection determination includes the presence of the ejection, measurement of the dot size, and measurement of the dot deposition position.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders. Moreover, although not shown in FIG. 1, the paper output unit 26A for the target prints is further provided with a paper reversing and conveying unit, which reverses the recording paper having been printed and conveys the reversed paper to the position between the first cutter 28 and the suction belt conveyance unit 22 in order to perform both sides printing on the recording paper.

Structure of the Print Heads

Next, the structure of the print heads is described. The print heads 12Bk, 12C and 12M excluding the Y head 12Y have the same structure, and a reference numeral 50 is hereinafter designated to any of the print heads 12Bk, 12C and 12M.

Figure 3A:
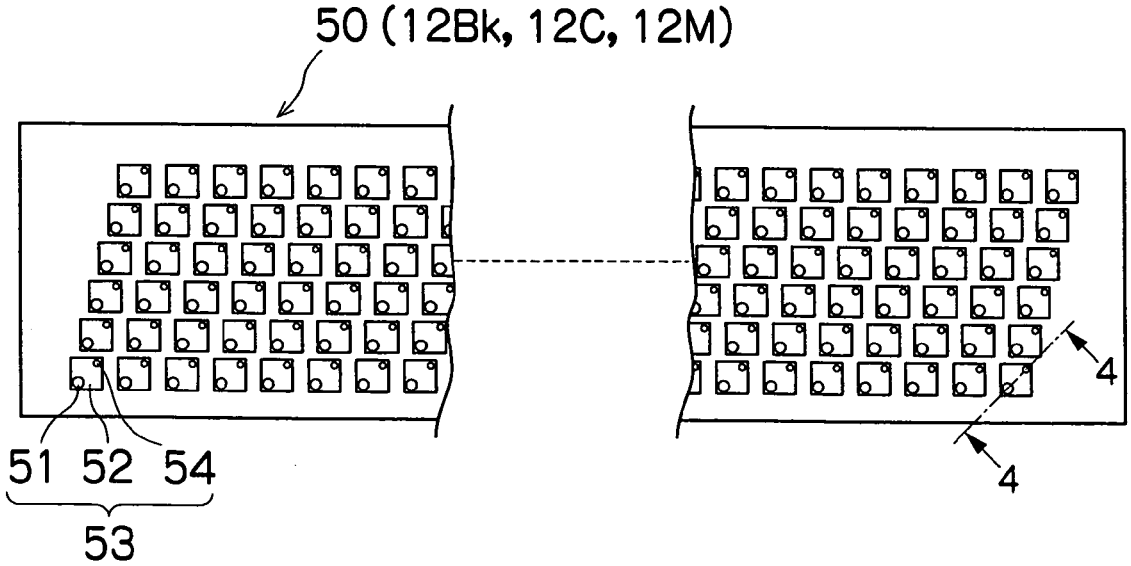
FIG. 3A is a perspective plan view showing an example of a configuration of a print head.
Figure 3B:
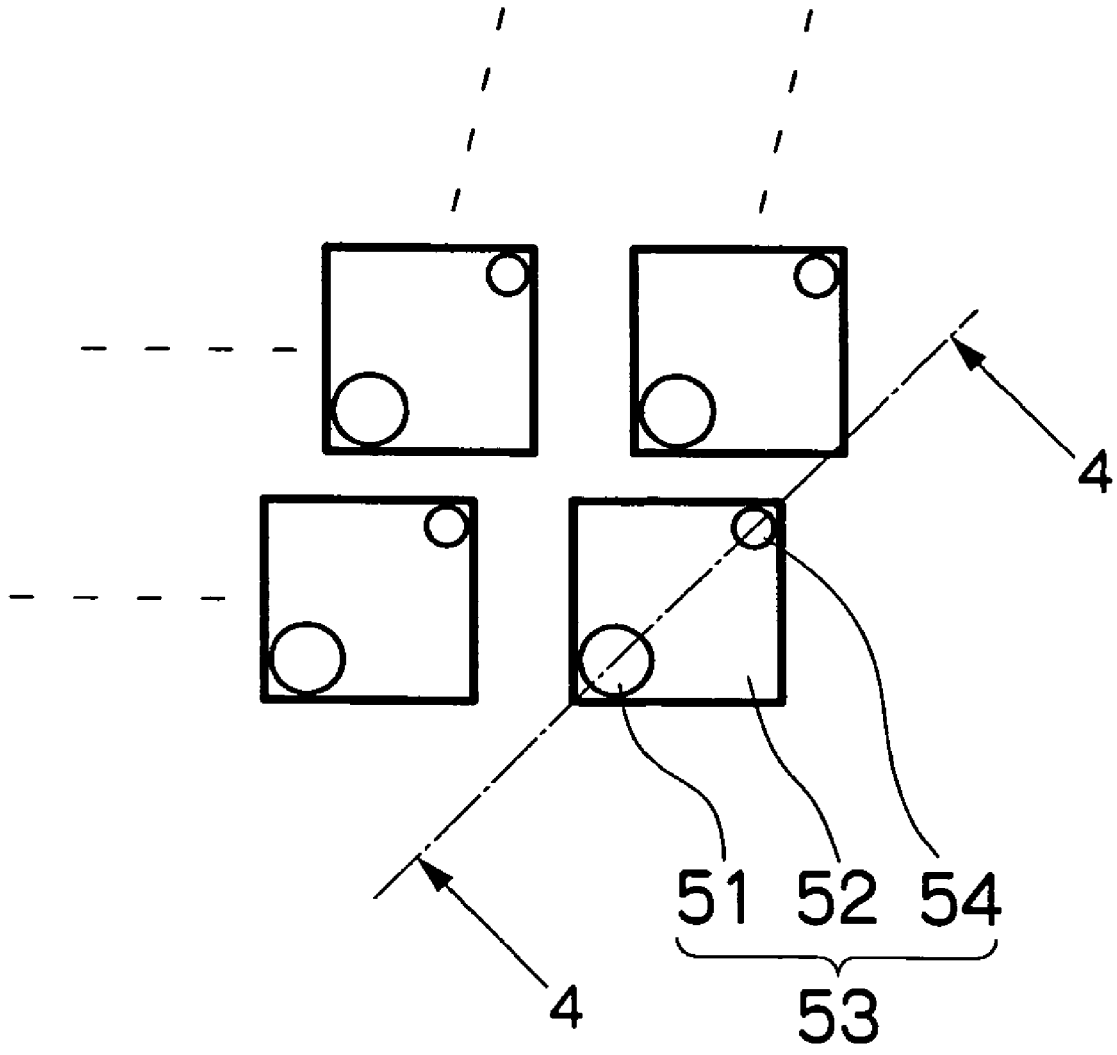
FIG. 3B is a partial enlarged view of FIG. 3A.
Figure 3C:
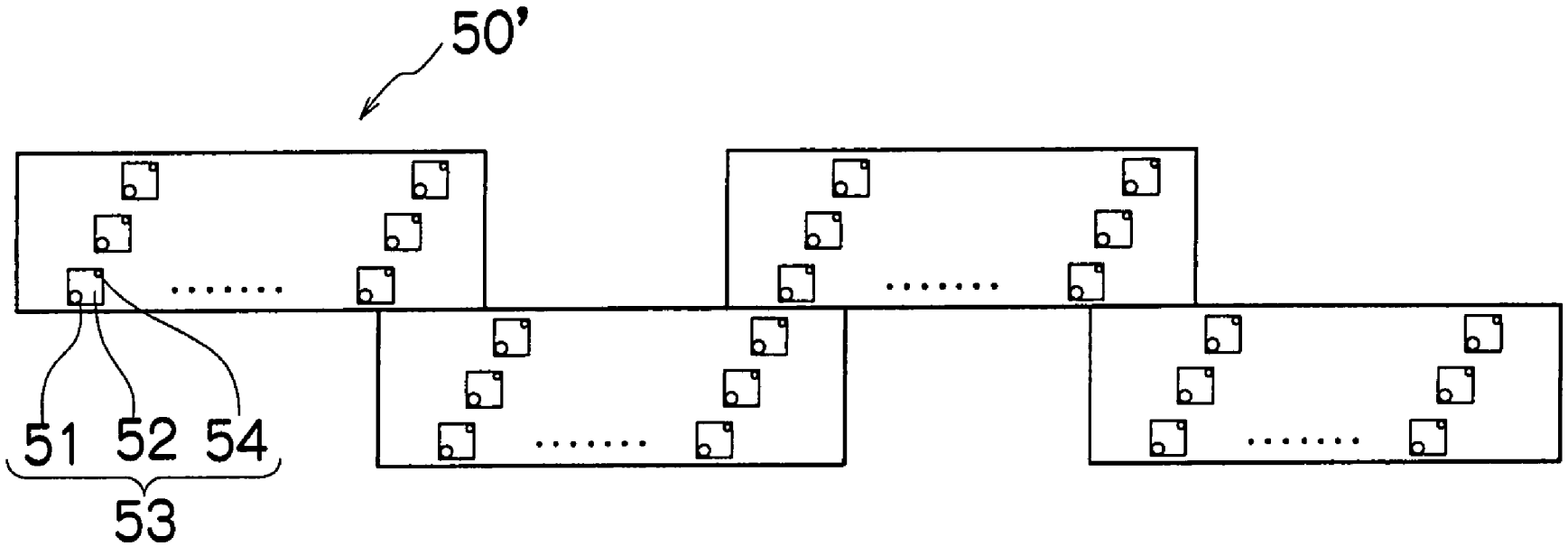
FIG. 3C is a perspective plan view showing another example of the configuration of the print head.
Figure 4:
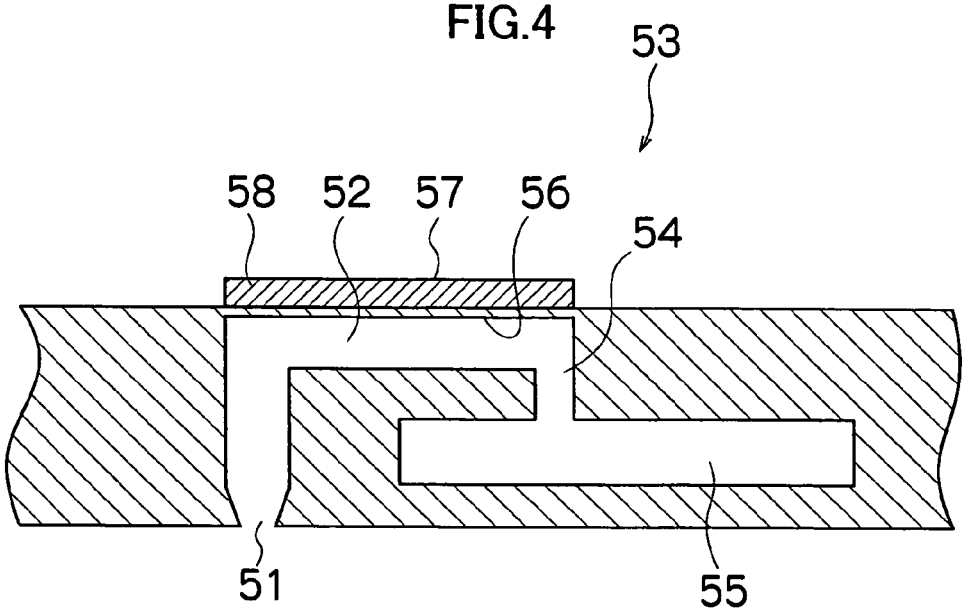
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units (recording elements) 53 including nozzles 51 for ejecting ink-droplets and pressure chambers (ink chambers) 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

In the implementation of the present invention, the structure of the nozzle arrangement is not particularly limited to the examples shown in the drawings. Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

As shown in FIGS. 3A to 3C, the planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink supply tank is delivered through the common flow channel 55 to the pressure chamber 52.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
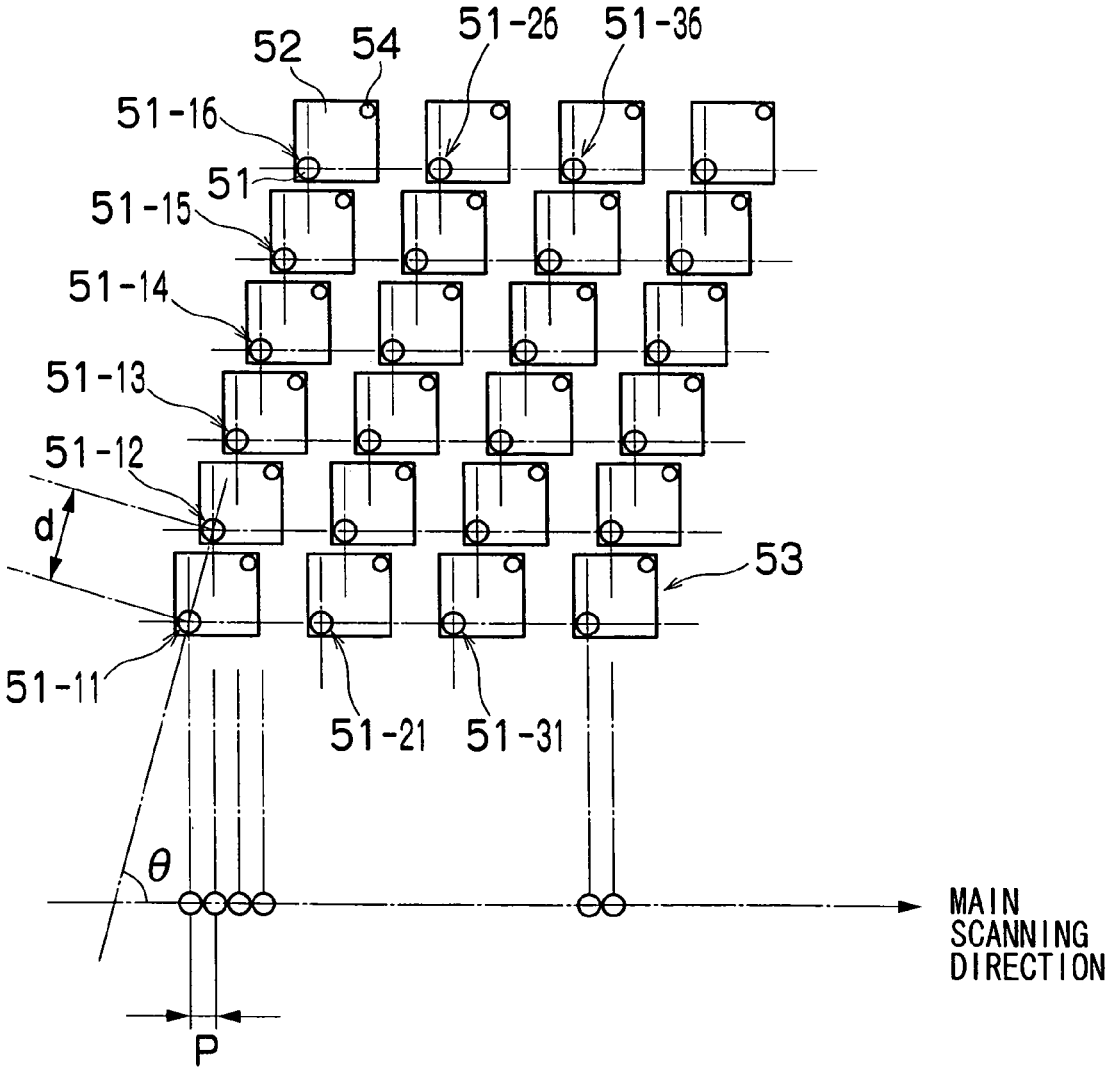
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi). For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles

51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

According to the above-described matrix structure, an effective projected nozzle pitch in the main scanning direction (the direction along the line head) of approximately 10 to 20 μm is achieved.

On the other hand, the Y head 12Y has a composition similar to that of the print head 50 described above, and is formed with yellow ink discharging nozzles so as to have a density of 600 npi, in addition to which, nozzles for discharging protective liquid are formed to a density of 150 npi inside the same head unit.

Naturally, the liquid supply passages differ between the nozzles for discharging yellow ink and the nozzles for discharging protective liquid, and furthermore, the respective nozzle rows are disposed at a suitable distance apart, in such a manner that the two liquids do not become mixed on the nozzle plate, due to the action of a cleaning blade 66 in FIG. 8, described hereinafter.

Figure 6A:
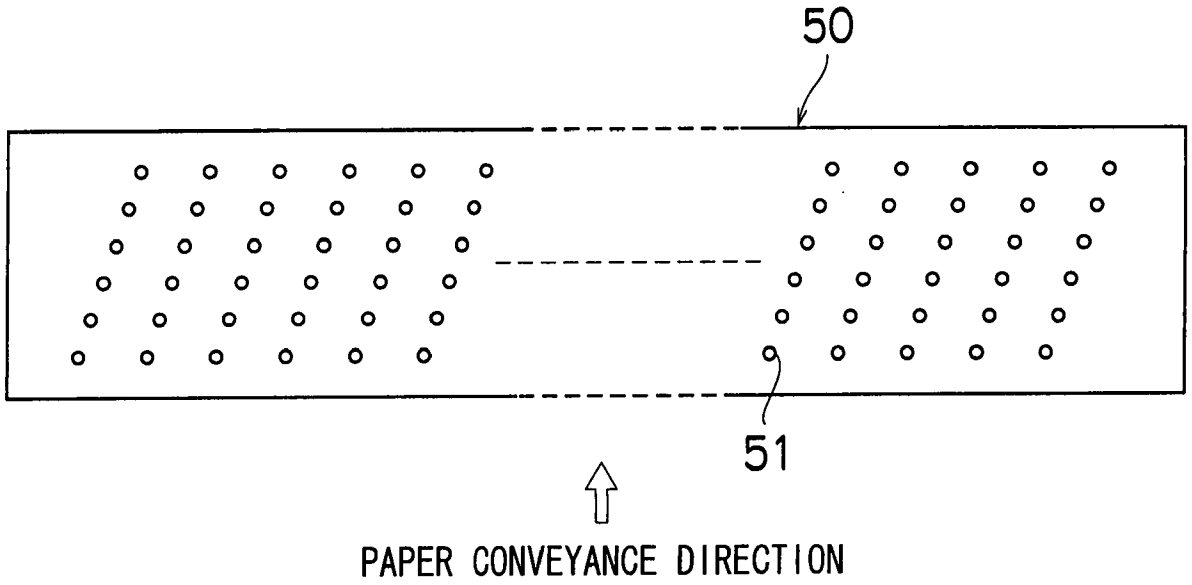
FIG. 6A is a schematic plan view showing a compositional example of a print head other than the Y head.
Figure 6B:
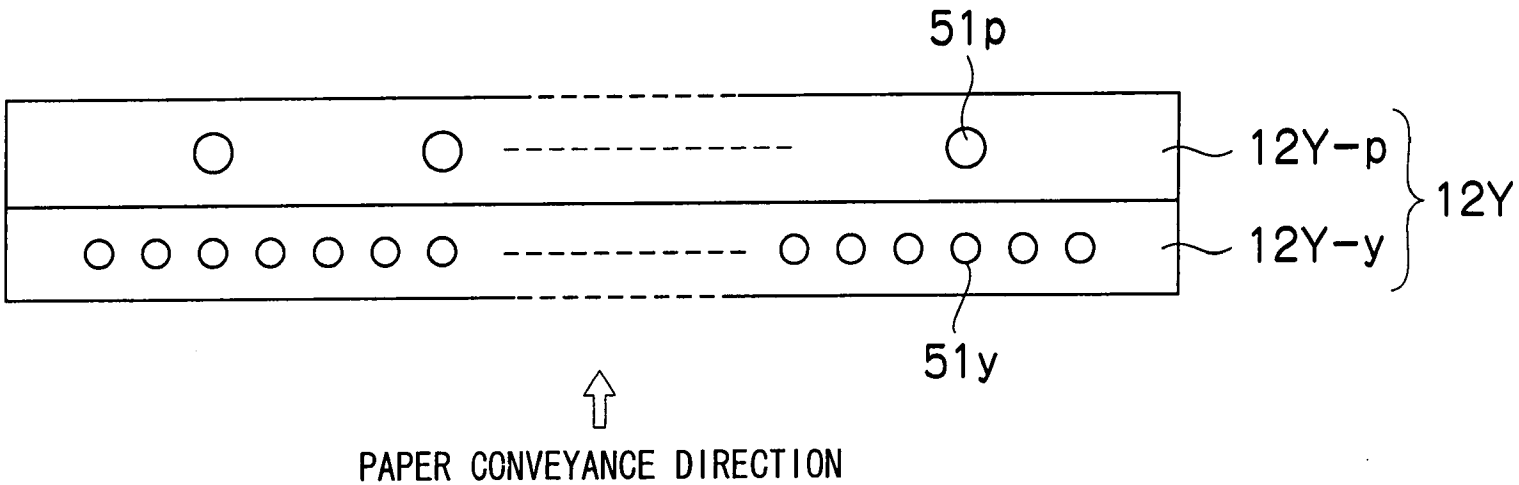
FIG. 6B is a schematic plan view showing a compositional example of the Y print head.

FIGS. 6A and 6B are schematic drawings showing a comparison between the composition of the print head 50 for a color other than yellow and the composition of the Y head 12Y. FIG. 6A shows the print head 50 other than the Y head, and FIG. 6B shows the Y head 12Y. In these drawings, the recording paper 16 is conveyed in the direction of the arrow, from the bottom towards the top in the plane of the sheet of the drawings.

As shown in FIG. 6B, the Y head 12Y includes a yellow ink discharging section 12Y-y, in which a plurality of nozzles 51*y* for discharging yellow ink are arranged, and a protective liquid discharging section 12Y-p, in which a plurality of nozzles 51*p* for discharging protective liquid are arranged. The row of nozzles in the protective liquid discharging section 12Y-p are disposed on the downstream side of the row of nozzles in the yellow ink discharging section 12Y-y, with respect to the direction of conveyance of the recording paper 16.

The nozzle density in the yellow ink discharging section 12Y-y is 600 npi, for example, which is approximately ¼ of the nozzle density of the print head 50 of a color other than yellow as shown in FIG. 6A, which is 2,400 npi, for example. Furthermore, the nozzle density in the protective liquid discharging section 12Y-p is 150 npi, for example, which is approximately ¼ of the nozzle density in the yellow ink discharging section 12Y-y.

On the basis of experimentation, when cyan and magenta were observed by a person with the naked eye, grained effect was considerable, and even if diluted inks of ¼th to ⅙th concentration of normal ink were used in combination, it was not possible to obtain an image of good quality, and more particularly, one without a grained appearance, unless the resolution is of 1,200 dpi or thereabouts, and more preferably, 1,440 dpi or thereabouts. In this case, the size of the dots of cyan and magenta were approximately 1.4 to 1.5 times the pixel size in 1,440 dpi resolution, and a condition was established wherein the whole droplet ejection range on the paper was covered by ink dots.

On the other hand, as is well known, when the color yellow is observed by the human eye, the shape of the dots is more difficult to recognize, compared to cyan or magenta, and hence the viewer is not liable to perceive a grained appearance, even if the dots are large. In other words, even if yellow is printed with dots which are larger than those of other colors, image deterioration is not liable to occur. According experiments wherein simulation images were created, the boundary at which this might become a problem in terms of image quality is at 300 to 400 dpi. In this case, the size of the yellow dots is approximately 1.3 to 1.5 times the pixel size at a resolution of 300 to 400 dpi.

Therefore, in the present embodiment, in the inkjet head of the print unit 12 which discharges ink of a plurality of colors, the number of nozzles for yellow ink is reduced in comparison to those of other colors (cyan, magenta, and the like), and the distance between the nozzles for the yellow ink is increased (the nozzle density is reduced). Moreover, not only is the nozzle arrangement affected, but also, control is performed whereby, when forming an image, the recording density of yellow ink dots on the printed image is also reduced.

In response to the decline in the concentration of the yellow color, due to the low recording density, the required image concentration can be can be obtained by a combination of methods, such as enlarging the individual dots, or increasing the ink concentration. In this case, the nozzle density for yellow is set to be ½ or less of the nozzle density of other colors, and generally the yellow dot density of the resulting image in the nozzle alignment direction is 400 dpi or above, and preferably, it is 600 dpi or above.

The difference between the perceptibility of dots of the respective colors, yellow, magenta and cyan, is due to the difference in the capability of the human eye to detect changes in shading (in this case, in different colors).

From experimentation, the capability for perceiving light and shade in the case of the color yellow was approximately ½ that relating to magenta and cyan, in terms of the spatial frequency of the maximum sensitivity with respect to change in shading, (in other words, a difference in color tone in yellow is not perceivable until it is approximately twice as great than that in magenta or cyan). Furthermore, the spatial frequency of high sensitivity is some ¼ of the spatial frequency of highest sensitivity for magenta and cyan, (on the print, a low spatial frequency means a long dimension, and in terms of dots, it means scattered dot spacing).

In the embodiment of the present invention, since dot density is considered, rather than differences in color concentration, the number of nozzles for yellow ink (number of dots) is preferably ½ or less of that for other colors, and more preferably, ⅓ or less of same, based on the experimentation described above.

These differences according to color occur as a result of the structure of the retina in the human eye. More specifically, the retina of the human eye comprises three types of cone cells for detecting colors, and rod cells for detecting brightness. The three types of cone cells correspond to the three primary colors of light, red, green and blue. The ratio of the numbers of cells of these three types is said to be generally, red:green:blue=40:20:1. Since this is the ratio of the number of cells on the retina, the ratio of the approximate distances between cells for the three colors is considered by taking the square roots of the ratio of the number of cells. That is, the ratio of the approximate distances between cells is considered to be, red:green:blue=$\sqrt{40}:\sqrt{20}:1 \approx 6:4:1$.

There is an overlap between the colors (light wavelengths) to which the different types of cone cells are actually sensitive, and the spatial resolving capacity is not simply determined by the aforementioned ratio, but the fact that the spatial resolving capacity for yellow, which is a complementary color of blue, is approximately ¼ that of magenta or cyan can be explained qualitatively from the fact stated above. The characteristics of the human eye described above are also used in technology for performing highly efficient decimation of color signals, such as encoding of video signal (NTSC system), for example.

In a normal shuttle scan type inkjet printer, since the dots of various colors are ejected simultaneously, the difference in dot density on the image resulting from the printing process is exactly the same as the difference in nozzle density. On the other hand, in a single pass type inkjet printer, considering nozzle density as viewed from the paper conveyance direction, the difference in dot density in the image resulting from the printing operation is also exactly the same as the difference in nozzle density, similarly to the shuttle scan type inkjet printer.

In a high quality printer, the recording density is nearly always 1,200 dpi or above, and therefore, if yellow is set to 600 dpi and the other colors are set to 1,200 dpi, then the nozzle density for yellow is one half that of the other colors. If the alignment length of the nozzles for the respective colors is the same, then the difference in nozzle density corresponds to the difference in the number of nozzles. Expressing the nozzle density in terms of npi (nozzles per inch), then a composition is adopted wherein the nozzles for cyan, magenta and black are set to 1,200 npi each, namely, 1,200 nozzles per inch, and the nozzles for yellow are set to 600 npi, namely, 600 nozzles per inch.

In the case of a single pass printer, for example, if a printing width of 12 inches corresponding to A3 size printing paper is printed at a resolution of 1,200 dpi, then there will be 14,400 nozzles respectively for cyan, magenta and black, and the resolution for yellow will be 600 dpi, meaning 7,200 nozzles. In other words, there will be 7,200 nozzles fewer for yellow than for each of the other colors, and consequently, the total number of nozzles can be significantly reduced.

In the case of the examples in FIGS. 6A and 6B, if a composition for printing a printing width of 12 inches at 2,400 dpi is adopted, then 28,800 nozzles will be provided respectively for cyan, magenta and black, while the color yellow will be printed at 1,200 dpi, and hence 14,400 nozzles will be provided for yellow. In other words, there will be 14,400 fewer nozzles provided for yellow than for each of the other colors. In this way, in a high-performance (high-density) single pass type composition, the effect of reducing the number of nozzles is even greater.

If the density of yellow is reduced in manner described above, then the number of dots of yellow ejected per unit area will be less than that of other colors, and since the dot density is smaller, the required concentration would not be obtainable by means of conventional methods. Therefore, in the present embodiment, the required concentration is obtained by adopting a mode wherein the dot size is increased by increasing the size of the ink droplets discharged in each discharge operation, or a mode wherein the dot size is increased by increasing the number of ink droplets ejected when creating a dot corresponding to one pixel, or a mode wherein dots are created by making the actual concentration of the yellow ink more intense than that of the other colors. These methods may be used independently, or a plurality of methods may be used in combination, as appropriate.

As shown in FIG. 6B, the nozzles 51*y* for discharging yellow ink have a larger nozzle diameter than the nozzles 51 for the other colors illustrated in FIG. 6A, and hence the size of the ink droplets discharged in one discharge operation is bigger than that for the other colors.

The nozzle diameter depends on the physical properties of the ink being used, such as the viscosity thereof, and the ink absorption characteristics of the recording medium. Preferably, the nozzles 51 for cyan, magenta and black, which print at a resolution of 2,400 dpi, have a diameter of approximately 25 μm. On the other hand, the nozzles for yellow 51*y*, which is printed at 600 dpi in the present embodiment, preferably have a diameter of approximately 60 μm. This can be determined in proportion to the cube root of the square of the ratio of the recording densities for the respective colors (in this case, $4^{2/3} \approx 2.52$). With these nozzle diameters, the volume of a yellow ink droplets will be approximately 16 times the volume of a cyan, magenta or black ink droplet, and in a recording medium used for high quality printing, it is possible to print without generating hardly any gaps. If using ink of the same physical properties, the size of the ink droplets discharged is not only affected by the nozzle diameter, but also by the balance between this and the cross-sectional area of the supply ports 54 of the respective pressure chambers 52, but in general, the ink volume is directly proportional to the third power of the ratio of the nozzle diameters.

However, if the recording density in the sub-scanning direction is different to the recording density in the main scanning direction, then the nozzle diameter ratio described above is not necessarily desirable.

In a single pass type inkjet recording apparatus, generally, it is relatively simple to increase the recording density in the sub-scanning direction, and therefore the recording density for yellow in the sub-scanning direction can be made higher than 600 dpi. If the recording density in the sub-scanning direction is made higher than the recording density in the main scanning direction in this way, then the nozzle diameter for yellow ink is preferably set between the diameter of 60 μm described above, and the nozzle diameter of 25 μm used for cyan, magenta and black.

If the dot size is increased by making the ink droplets larger, or if the dot size is increased by increasing the number of ink droplets, then the ink volume is preferably set in such a manner that the dot size on the printing paper used is approximately 1.3 to 1.5 times greater than the dot density for yellow.

Furthermore, if the required concentration is obtained by making the concentration of the yellow ink more intense, then it is suitable to choose an ink concentration whereby, in a state where yellow dots have been ejected onto all of the pixels on the printing paper (a state where yellow dots have been printed onto the entire surface of the printing paper), the STATUS A reflective concentration is 1.8 to 2.0.

However, if the dot size is smaller than the pixel density, the white background of the printing paper is exposed, and even if ink of intense concentration is used, it may not be possible to obtain the desired concentration, and therefore it is desirable to use a method for increasing the dot size in conjunction with the use of concentrated ink.

Furthermore, by reducing the density of the yellow nozzles 51*y*, the Y head will require smaller dimensions than the heads of the other colors, and therefore the space saved in the Y head 12Y can be used to install a nozzle for discharging a liquid having another function.

In the present embodiment, an example is described wherein the nozzles 51*p* for discharging protective liquid are added. Examples of functional liquids other than ink include, for instance, liquids for fixing the ink, coating liquids for protecting the ink coloring materials from oxygen, ozone, or ultraviolet rays, and protective film liquids for protecting the ink from abrasion or scratching.

As described above, the yellow ink is ejected in larger dots or using more concentrated ink than the inks of other colors, but it is also possible to form an image by means of tonal modification (tonal graduation) wherein different tones are represented by changing the size or concentration of respective dots, and it is also possible to form an image by means of surface area modification (surface area graduation), such as error diffusion, dithering, wherein different tones are represented by printing, or not printing respective dots.

Furthermore, if an image is formed by means of error diffusion or another type of surface area modification, then the droplet size of the yellow ink is taken as one size, and the drive circuits and control method can be simplified. In this case, the other colors may be modified in terms of dot size or concentration, and they may also be subjected to surface area modification, similarly to the yellow ink.

If a plurality of ink droplets are ejected onto the same position of the recording paper 16, or if a plurality of ink droplets are ejected onto adjacent positions whereby they make mutual contact on the recording paper 16, then the liquid will consolidate on the recording paper, due to the surface tension of the droplets, and hence the dot shape will be approximate to the dot shape formed by one single ink droplet, and a dot of larger dot size and of more intense concentration than one created by a single ink droplet will be formed.

If images are formed by modifying the dot size or modifying the concentration of colors other than yellow, then the number of different dot sizes of the yellow ink on the printed object (the recording paper 16) will be less than the number of different dot sizes of one or more of the other inks on the printed object. In this case, in particular, by setting the droplet size for the yellow ink to one size only, the drive circuit and control method for the yellow ink can be simplified, and discharge failure can also be made less liable to occur by ejecting large droplets at all times, and hence the reliability is further improved.

The dot size of the yellow ink on the printed object is preferably greater than the smallest dot size of the various dot sizes of the other inks on the printed object. Furthermore, the dot size of the yellow ink on the printed object is preferably not less than the largest dot size of the dot sizes of the other inks on the printed object.

The discharge frequency for the yellow ink is preferably at most one half of at least one of the discharge frequency for the cyan ink and the discharge frequency for the magenta ink, and more preferably, the discharge frequency for the yellow ink is 1/n (where $n \geqq 2$, n is an arbitrary number) of at least one of the discharge frequency for the cyan ink and the discharge frequency for the magenta ink.

Generally, suitable quality can be obtained if the recording pixel density for the three or more types of ink, including cyan, magenta and yellow, on the printed object is 2,540 dpi, or below.

FIGS. 7A, 7B and 7C show examples of dot arrangements for cyan, magenta and black (1,440 dpi) and dot arrangements for yellow (400 dpi). In these drawings, the lateral direction of the drawing sheet is the longitudinal direction of the head, and the vertical direction of the drawing sheet is the paper conveyance direction.

In the example illustrated, the dot size for colors other than yellow is approximately 30 μm (FIG. 7A), and the dot size for yellow ink is larger than this, at approximately 108 μm (FIG. 7B).

The recording density of the dots aligned in the longitudinal direction of the head corresponds to the nozzle density projected to an alignment in this direction. Furthermore, the recording density of the dots in the paper conveyance direction is governed by the speed of conveyance of the recording paper 16 and the ink discharge frequency. In FIGS. 7A and 7B, the discharge frequency for the yellow ink is one third of the discharge frequency for the inks of other colors.

A color image is formed by means of the recording dots in these dot positions of different recording density (shown FIGS. 7A and 7B) appearing in an overlapping fashion on the actual printed object, as shown in FIG. 7C.

It is thus possible to form the image from the dots among which the yellow dots are larger than those of the other colors, with relatively simple image processing calculation.

In another embodiment, the yellow ink is ejected in dots of the same size with the cyan ink and the magenta ink as follows. For example, the nozzle density is 1,440 npi for each of cyan, magenta and black, and the nozzle density is 720 npi for only yellow. In this case, the dots of the yellow ink are formed in the main scanning direction with the density of 720 dpi, and the dot density of yellow is then one half of the dot density of each of cyan, magenta and black of 1,440 dpi in the main scanning direction. If the discharge frequency for the yellow ink is set to be twice the discharge frequency for each of the cyan ink, the magenta ink and the black ink, then the dot density of yellow in the sub-scanning direction is twice the dot density of each of cyan, magenta and black, so that the two dimensional dot density of yellow is substantially equal to the dot density of each of cyan, magenta and black. Thus, although the nozzles for the yellow ink are fewer than the other colors, the dot density of yellow can be made substantially equal to the dot densities of the other colors.

Consequently, in the construction where the nozzle density for yellow is set to be at most one half of the nozzle density of each of cyan and magenta, the discharge frequency for the yellow ink is preferably set to be at least twice the discharge frequency for at least one of the cyan ink and the magenta ink in order to substantially equalize the two dimensional dot densities of yellow, cyan and magenta. More preferably, the discharge frequency for the yellow ink is set to be n times (where $n \geqq 2$, n is an arbitrary number and preferably more than 2) the discharge frequency for at least one of the cyan ink and the magenta ink.

Composition of Ink Supply System

FIG. 8 is a schematic drawing showing the configuration of the ink supply system in the inkjet recording apparatus 10. An ink supply tank 60 is a base tank that supplies ink or protective liquid (hereinafter referred to as simply "ink") and is set in the ink and protective liquid storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 8 is equivalent to the ink and protective liquid storing and loading unit 14 in FIG. 1 described above.

A filter 62 for removing foreign matters and bubbles is disposed between the ink supply tank 60 and the print head 50, 12Y, as shown in FIG. 8. The filter mesh size in the filter 62 is preferably equivalent to or less than the diameter of the nozzle and commonly about 20 μm.

Although not shown in FIG. 8, it is preferable to provide a sub-tank integrally to the print head 50, 12Y or nearby the print head 50, 12Y. The sub-tank has a damper function for preventing variation in the internal pressure of the head and a function for improving refilling of the print head.

The inkjet recording apparatus 10 is also provided with a cap 64 as a device to prevent the nozzles 51, 51*y* and 51*p* (hereinafter referred to as simply "51") from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50, 12Y by a movement mechanism (not shown), and is moved from a predetermined holding position to a maintenance position below the print head 50, 12Y as required.

The cap 64 is displaced up and down in a relative fashion with respect to the print head 50, 12Y by an elevator mechanism (not shown). When the power of the ink-jet recording apparatus 10 is switched OFF or when in a print standby state, the cap 64 is raised to a predetermined elevated position so as to come into close contact with the print head 50, 12Y, and the nozzle face is thereby covered with the cap 64.

The cleaning blade 66 is composed of rubber or another elastic member, and can slide on the ink discharge surface (surface of the nozzle plate) of the print head 50, 12Y by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50, 12Y (inside the pressure chamber), the cap 64 is placed on the print head 50, 12Y, ink (ink in which bubbles have become intermixed) inside the pressure chamber 52 is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50, 12Y continues for a certain amount of time or longer, the ink solvent in the vicinity of the nozzles 51 evaporates and ink viscosity increases. In such a state, ink can no longer be discharged from the nozzle 51 even if the actuator 58 is operated. Before reaching such a state the actuator 58 is operated (in a viscosity range that allows discharge by the operation of the actuator), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 58 is operated. Also, when the ink viscosity inside the nozzle 51 has increased over a certain level, ink can no longer be discharged from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

The cap 64 described with reference to FIG. 8 serves as the suctioning device and also as the ink receptacle for the preliminary discharge.

In the present embodiment, for yellow ink, the total number of nozzles is small, the nozzle density is low, and the size of the droplets discharged is large, and therefore, the nozzle diameter is larger than that for other colors, and the ink passage inside the head is thicker (it has a larger cross-sectional area). Therefore, for yellow ink, ink blockage due to air bubbles, or the like, is not liable to occur, and it can be expected that a lower frequency of nozzle maintenance will be sufficient in comparison with the other colors.

Description of Control System

Figure 9:
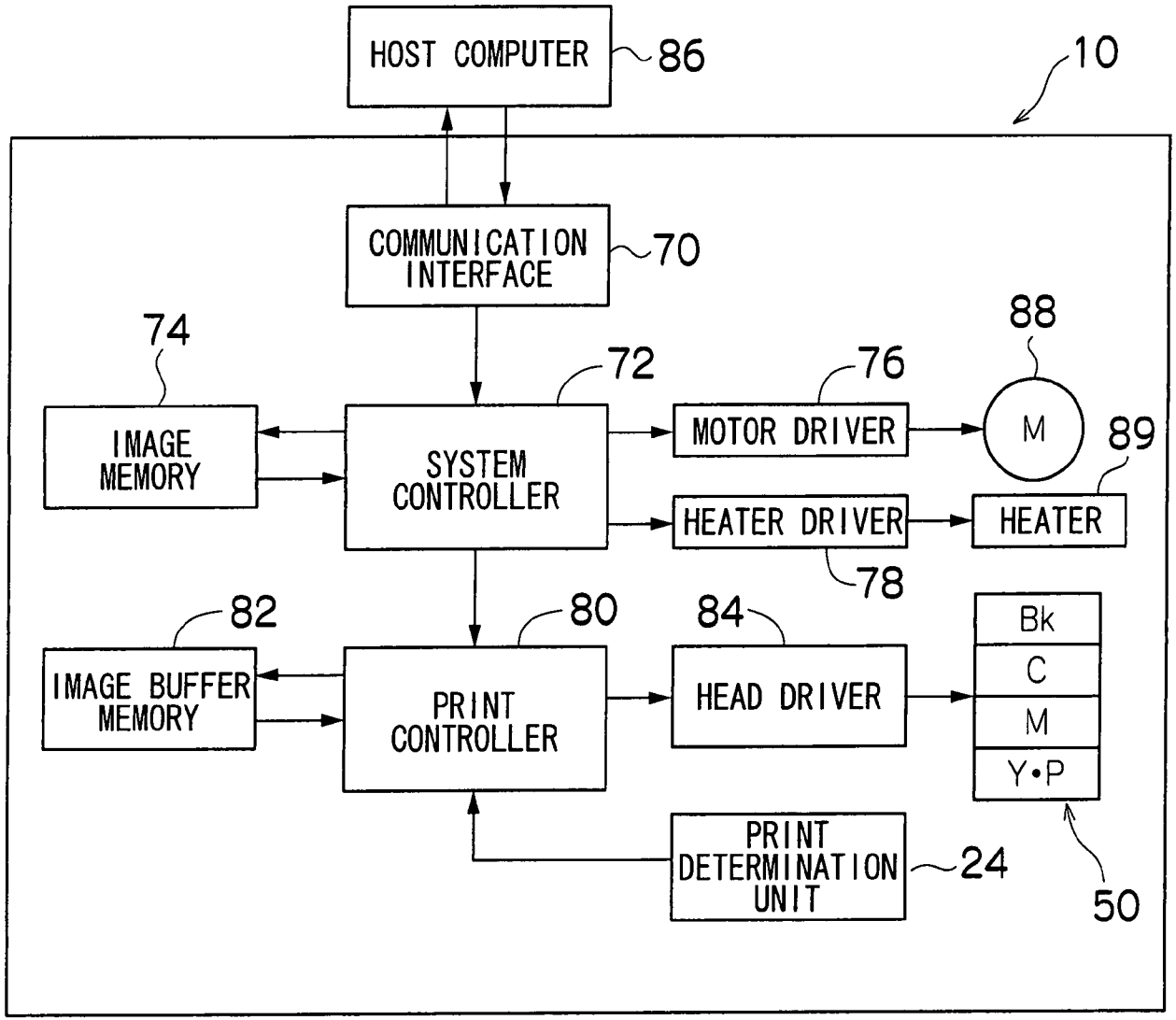
FIG. 9 is a principal block diagram showing the system composition of the ink-jet recording apparatus.

FIG. 9 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (image formation data) to the head driver 84.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84.

The signals corresponding to black (Bk), cyan (C), magenta (M) and yellow (Y) supplied to the head driver 84 are processed in accordance with the nozzle densities in the head corresponding to the respective colors.

Furthermore, rather than setting the signal for discharging protective liquid, in such a manner that liquid is discharged over the full surface of the recording paper 16, it is also possible to adopt a mode wherein it is set in such a manner that protective liquid is discharged selectively onto a partial region of the recording paper. For example, it may be set in such a manner that protective liquid is discharged only onto the portion where ink has been discharged, or it may be set in such a manner that protective liquid is discharged only onto the portion where ink of low durability has been discharged, or it may be set in such a manner that protective liquid is discharged onto all or a portion of the image apart from a portion designated as "to be erased, or to be left erasable", in such a manner that the image can be erased partially at a later time.

Prescribed signal processing is carried out in the print control unit 80, and the discharge amount and the discharge timing of the ink droplets or the protective liquid from the respective print heads 12Bk, 12C, 12M and 12Y, are controlled via the head drier 84, on the basis of the image data. By this means, prescribed dot size, dot positions, or coating of protective liquid can be achieved. The print control unit 80 is provided with the recording control device according to the embodiment of the present invention.

The print controller 80 is provided with the image buffer memory 82; and image data, parameters, and other data are temporarily stored in the image buffer memory 82 when image data is processed in the print controller 80. The aspect shown in FIG. 9 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12Bk, 12C, 12M, and 12Y of the respective colors on the basis of the image formation data received from the print controller 80. A feedback control system for keeping the drive conditions for the print heads constant may be included in the head driver 84.

Unlike the heads of other colors, which are driven in such a manner that they only discharge minute droplets of approximately 2 picoliters (pl), the Y head 12Y is driven in such a manner that it can discharge ink of different volumes, since the dot size thereof is modified. Furthermore, the protective liquid discharging section 12Y-p also provided in the Y head 12Y has a low nozzle density, but since it is not required to discharge droplets of different volumes, it is driven in such a manner that it discharges protective liquid droplets of the same volume.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80. The read start timing for the line sensor is determined from the distance between the line sensor and the nozzles and the conveyance velocity of the recording paper 16.

The print controller 80 makes various compensation with respect to the print head 12Bk, 12C, 12M and 12Y as required on the basis of the information obtained from the print determination unit 24.

Figure 10:
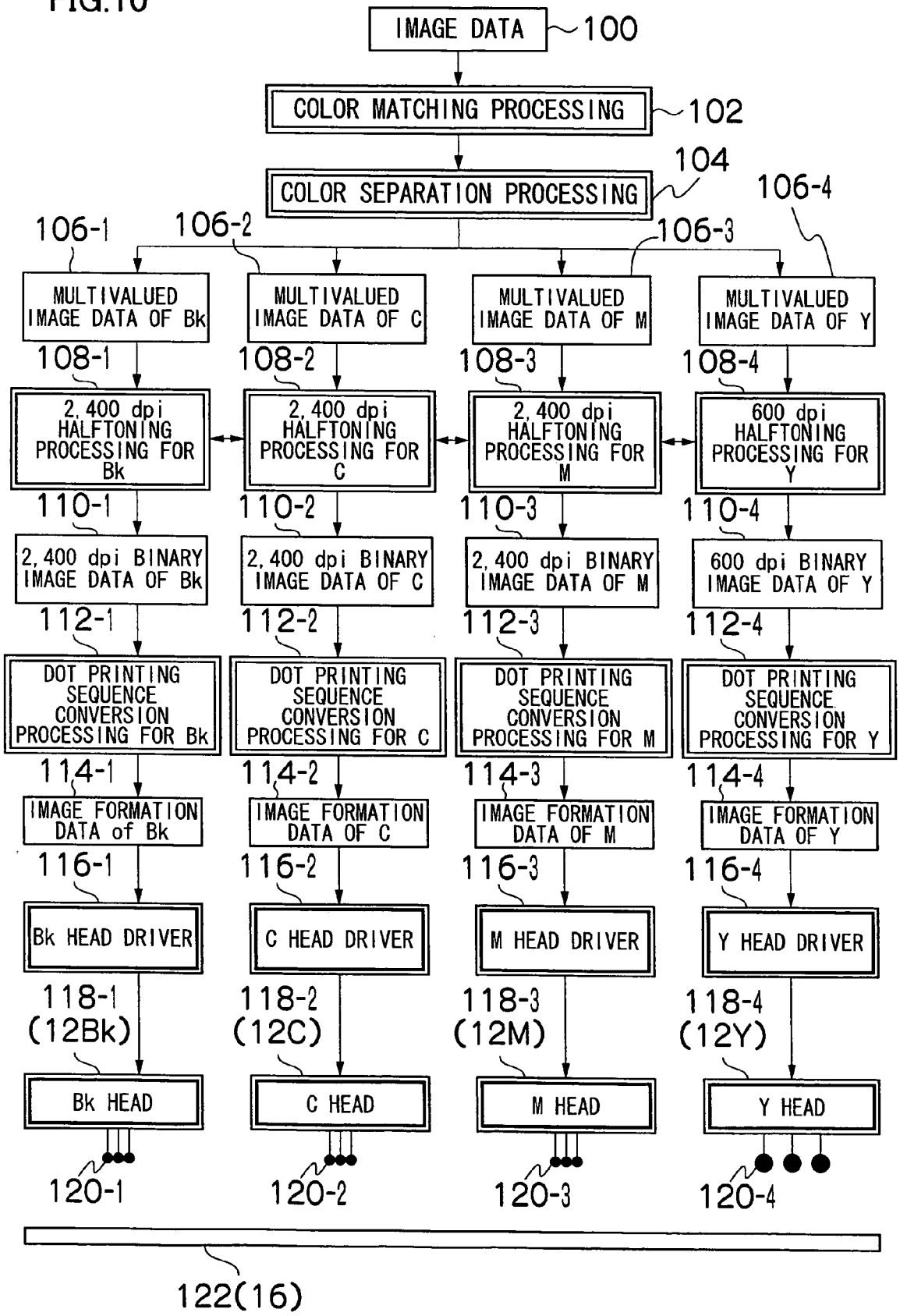
FIG. 10 is an explanatory diagram including a flowchart of the image recording control in the inkjet recording apparatus.

FIG. 10 is an explanatory diagram including a flowchart of the image recording control in the inkjet recording apparatus 10 according to the embodiment of the present invention.

When original image data 100 (e.g., the data in RGB, of 8 bits and 400 dpi for each color) is inputted, the image data is converted in accordance with the color reproduction characteristic of the inkjet recording apparatus 100 in a color matching processing 102. In this processing, the dot density is not changed but the values in the RGB data representing the colors are changed. In the present example, the original image data is converted to the data in RGB, of 10 bits and 400 dpi for each color.

Then, the RGB data is converted to CMYBk data in a color separation processing 104. In the present example, the RGB data is converted to the data in CMYBk, of 10 bits and 400 dpi for each color. The multivalued image data of each color thereby produced (color-separated) in the color separation processing 104 is denoted with a reference numeral 106-i (where i=1, 2, 3, 4) in FIG. 10.

Then, the multivalued image data 106-i (where i=1, 2, 3, 4) of each color is converted to binary data in a halftoning processing 108-i (where i=1, 2, 3, 4) according to an error diffusion method, or the like. The halftoning processing 108-i (i=1, 2, 3, 4) binarizes the multivalued image data of each color, and also performs resolution conversion. As the conversion method, various methods such as error diffusion method, blue noise masking method, and thresholding method can be used. The lateral two-headed arrows in FIG. 10 represent that the arrangement is also considered between the colors. In the present example, among the data in CMYBk, each of the data of black, cyan and magenta is converted to the data of 1 bit and 2,400 dpi for each color, and the data of yellow is converted to the data of 1 bit and 600 dpi. The binary image data of each color thereby produced (binarized) in the halftoning processing 108-i (i=1, 2, 3, 4) is denoted with a reference numeral 110-i (i=1, 2, 3, 4) in FIG. 10.

The binary image data of each color is converted to a data sequence (dot data) considering the dot printing sequence in a print sequence conversion processing 112-i (i=1, 2, 3, 4). More specifically, the print sequence conversion processing 112-i (i=1, 2, 3, 4) performs processing to convert the binary image data of each color to the data sequence according to the head composition, construction, and image formation sequence.

Image formation data 114-i (i=1, 2, 3, 4) of each color is thereby produced. The image formation data 114-i (i=1, 2, 3, 4) are the image data for driving a head driver 116-i (i=1, 2, 3, 4) of each color. The head driver 116-i (i=1, 2, 3, 4) of each color drives a head 118-i (i=1, 2, 3, 4) of each color according to the image formation data 114-i (i=1, 2, 3, 4) of each color while synchronizing with a clock signal (not shown). The head drivers 116-i (i=1, 2, 3, 4) of the respective colors shown in FIG. 10 are equivalent to the head driver 84 described with reference to FIG. 9, and the heads 118-i (i=1, 2, 3, 4) of the respective colors shown in FIG. 10 are equivalent to the heads 12Bk, 12C, 12M and 12Y described with reference to FIG. 1.

Thus, as shown in FIG. 10, ink droplets 120-i (i=1, 2, 3, 4) are discharged from the heads 118-i (i=1, 2, 3, 4) of the respective colors, and an image is consequently formed on a recording medium 122, which is equivalent to the printing paper 16 described with reference to FIG. 1.

In FIG. 10, the conditions of the ink droplets 120-i (i=1, 2, 3, 4) discharged from the heads 118-i (i=1, 2, 3, 4) of the respective colors are schematically illustrated. As shown in FIG. 10, the recording density of the Y head 118-4 is lower than those of the Bk, C and M heads 118-1, 118-2 and 118-3.

In the embodiment described above, a method is employed wherein an ink droplet is ejected by means of the deformation of the actuator 58, which is, typically, a piezoelectric element, but in implementing the present invention, the method used for discharging ink is not limited in particular, and instead of the piezo jet method, it is also possible to apply various other types of methods such as a thermal jet method, wherein the ink is heated and bubbles are caused to form therein, by means of a heat generating body such as a heater, ink droplets being ejected by means of the pressure of these bubbles.

In the present embodiment, an inkjet recording apparatus using a page-wide full line head having a nozzle row of a length corresponding to the entire width of the recording medium has been described, but the scope of application of the present invention is not limited to this, and the present invention may also be applied to an inkjet recording apparatus using a shuttle scanning type head which performs image recording while moving a recording head of short dimensions, in a reciprocal fashion.

Moreover, in the foregoing description, an inkjet recording apparatus has been described as one example of an image forming apparatus, but the scope of application of the present invention is not limited to this. The present invention can also be applied to image forming apparatuses based on various types of methods other than an inkjet method such as a thermal transfer recording apparatus using a line head, an LED electrophotographic printer, or a silver halide photographic type printer having an LED line exposure head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus which forms an image on a recording medium by using coloring materials of a plurality of colors including at least cyan, magenta and yellow, the apparatus comprising:

a cyan recording head which has a plurality of cyan recording elements for forming cyan recording pixels on the recording medium;

a magenta recording head which has a plurality of magenta recording elements for forming magenta recording pixels on the recording medium;

a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head, wherein the yellow recording head includes a liquid discharging head which has nozzles for discharging at least one of a liquid for fixing an ink used as the coloring materials onto the recording medium, a coating liquid for protecting pigment in the coloring materials, and a liquid for forming a protective film for protecting the coloring materials from rubbing or abrasion, and a density of the nozzles of the liquid discharging head is substantially less than the density of the plurality of yellow recording elements.

2. An image forming apparatus which forms an image on a recording medium by using coloring materials of a plurality of colors including at least cyan, magenta and yellow, the apparatus comprising:

a cyan recording head which has a plurality of cyan recording elements for forming cyan recording pixels on the recording medium;

a magenta recording head which has a plurality of magenta recording elements for forming magenta recording pixels on the recording medium;

a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head, wherein the yellow recording pixels are recorded onto the recording medium by means of control involving at least one of a size modification and a concentration modification of the yellow recording pixels.

3. An image forming apparatus which forms an image on a recording medium by using coloring materials of a plurality of colors including at least cyan. magenta and yellow, the apparatus comprising:

a cyan recording head which has a plurality of cyan recording elements for forming cyan recording pixels on the recording medium;

a magenta recording head which has a plurality of magenta recording elements for forming magenta recording pixels on the recording medium;

a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head, wherein the yellow recording pixels are recorded onto the recording medium by means of control involving a surface area modification of the yellow recording pixels.

4. An image forming apparatus which forms an image on a recording medium by using coloring materials of a plurality of colors including at least cyan, magenta and yellow, the apparatus comprising:

a cyan recording head which has a plurality of cyan recording elements for forming cyan recording pixels on the recording medium;

a magenta recording head which has a plurality of magenta recording elements for forming magenta recording pixels on the recording medium;

a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head, wherein the recording density of the yellow recording pixels is not less than 300 dpi and not more than 600 dpi, and each of the recording density of the cyan recording pixels and the recording density of the magenta recording pixels is not less than 1,200 dpi.

5. An image forming apparatus which forms an image on a recording medium by using coloring materials of a plurality of colors including at least cyan, magenta and yellow, the apparatus comprising:

a cyan recording head which has a plurality of cyan recording elements for forming cyan recording pixels on the recording medium;

a magenta recording head which has a plurality of magenta recording elements for forming magenta recording pixels on the recording medium;

a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head, wherein each of the cyan recording elements, the magenta recording elements and the yellow recording elements comprises:

a nozzle which discharges ink of a corresponding color:

an ink chamber which is connected to the nozzle and is filled with the ink to be discharged from the nozzle; and a pressure generating device which supplies discharge force by pressurizing the ink inside the ink chamber, the recording pixels of the corresponding color are formed on the recording medium by means of the corresponding color ink droplets discharged from the nozzle, and a diameter of the nozzles of the yellow recording elements is greater than each of a diameter of the nozzles of the cyan recording elements and a diameter of the nozzles of the magenta recording elements.

6. An image forming apparatus which forms an image on a recording medium by using coloring materials of a plurality of colors including at least cyan, magenta and yellow, the apparatus comprising:

a cyan recording head which has a plurality of cyan recording elements for forming cyan recording pixels on the recording medium;

a magenta recording head which has a plurality of magenta recording elements for forming magenta recording pixels on the recording medium;

a yellow recording head which has a plurality of yellow recording elements for forming yellow recording pixels on the recording medium, a density of the plurality of yellow recording elements arranged in the yellow recording head being lower than each of a density of the plurality of cyan recording elements arranged in the cyan recording head and a density of the plurality of magenta recording elements arranged in the magenta recording head; and a recording control device which controls a recording operation in such a manner that a recording density of the yellow recording pixels formed on the recording medium with the yellow recording head is lower than each of a recording density of the cyan recording pixels formed on the recording medium with the cyan recording head and a recording density of the magenta recording pixels formed on the recording medium with the magenta recording head, wherein each of the cyan recording elements, the magenta recording elements and the yellow recording elements comprises:

a nozzle which discharges ink of a corresponding color;

an ink chamber which is connected to the nozzle and is filled with the ink to be discharged from the nozzle; and a pressure generating device which supplies discharge force by pressurizing the ink inside the ink chamber, the recording pixels of the corresponding color are formed on the recording medium by means of the corresponding color ink droplets discharged from the nozzle, and the yellow recording elements are driven to discharge the yellow ink droplets at a higher frequency than an ink discharge frequency determined according to a relative speed of the recording medium and the yellow recording head, and the recording density of the yellow recording pixels; and one yellow recording pixel is formed by a plurality of yellow ink droplets.

* * * * *